US005240651A

United States Patent [19]

Rawal

[11] Patent Number: 5,240,651

[45] Date of Patent: Aug. 31, 1993

[54] ADIABATIC MODULATOR PROPORTIONING REFRIGERATION CONTROLLER DESUPERHEATER

[76] Inventor: Davis I. Rawal, 25 Maybrook Rd., Waterbury, Conn. 06708

[21] Appl. No.: 855,589

[22] Filed: Apr. 23, 1992

Related U.S. Application Data

[63] Continuation of Ser. No. 726,877, Jul. 8, 1991, abandoned.

[51] Int. Cl.[5] ..... B05B 7/02

[52] U.S. Cl. ..... 261/78.2; 261/DIG. 13; 62/196.1; 62/197; 122/438; 122/487

[58] Field of Search ..... 62/197, 196.1, 193.3, 62/196.4, 117, DIG. 17; 261/79.2, 152, 78.2, DIG. 13; 122/438, 487; 165/110

[56] References Cited

U.S. PATENT DOCUMENTS 2,461,760 2/1949 Newton ..... 62/205

3,201,950 8/1965 Shrader ..... 62/197

*Primary Examiner*—John M. Sollecito

*Attorney, Agent, or Firm*—John P. Halvonik

[57] ABSTRACT

The invention relates to a close-coupled hot gas bypass, system for a proportioning refrigeration controller that controls the refrigeration capacity within the pressurized system. This is accomplished through the use of a hot gas bypass line and a liquid line that are combined in a desuper heat chamber and then fed through to the vacuum line to compensate for changes in the vacuum line pressure. The unique construction of the desuper heat chamber allows for vertical or horizontal placement in retrofit applications. The use of a thermal expansion valve for providing cooling gas from the liquid line to cool the hot bygas as the need arises allows for continous use of the system without the need for an accumulator in the vacuum line to prevent liquid slugging common in close-coupled systems.

10 Claims, 3 Drawing Sheets

ADIABATIC MODULATOR PROPORTIONING REFRIGERATION CONTROLLER DESUPERHEATER

This application is a continuation-in-part of Ser. No. 726,877, filed Jul. 8, 1991, now abandoned.

BACKGROUND OF THE INVENTION

In refrigeration systems, hot gas bypass lines are used to transfer the discharge gas from the compressor to the low pressure (vacuum line) side of the compressor. Their purpose is to artificially load the compressor upon a drop in pressure load in order to prevent: a drop in evaporator temperature, frosting up of the evaporator coil, operation of the compressor at excessively low back pressures or short cycling of the compressor.

There are a number of methods of bypassing hotgas including: 1) bypassing the gas to the exit of the evaporator section (at a point upstream of the equalizer bulb used for the thermal expansion valve that feeds the gas into the evaporator section from the liquid line); or 2) bypassing the hot gas to the entrance of the evaporator; or 3) simply bypassing the hot gas at a point upstream of the compressor, but downstream of the equalizer bulb mentioned in method 1, this system may be referred to as a close-coupled system.

A close-coupled hot gas bypass system would be desirable over the other by-pass methods since the close coupled system eliminates the large amount of tubing required to bring the gas back to the evaporator. However, these close-coupled bypass systems suffer problems with excessive heating and slugging. Excessive heating of the suction gas (coming from the evaporator to the compressor) can damage the compressor parts. Slugging involves the buildup of liquid in the compressor which also causes damage as the compressor is designed for gas. Prior art teaches that such systems should use an accumulator in the vacuum line to prevent the slugging of oil back to the compressor or to drop the close coupled idea altogether because of the inherent lack of close coupling or to only use this method for a short time.

SUMMARY OF THE INVENTION

It is the object of the invention to retain the simple hot gas bypass design to achieve the advantages of minimal tubing required for installation and for retrofit applications while eliminating the afore mentioned drawbacks of such systems. Toward this end, the invention comprises a close coupled hot gas bypass system which uses a hot gas bypass line and a liquid line both fed to a desuperheat chamber and from the desuper heat chamber into the vacuum line. Hot gas is bypassed as the pressure in the vacuum line drops and, if pressure in the vacuum line builds up, cool liquid/gas from the liquid line is brought to the desuper heat chamber through the use of a thermal expansion valve to cool the hot gas being bypassed back.

It is the objective of the invention to provide a close coupled hot gas bypass proportioning system that eliminates the problems of slugging and overheating found in simple hot gas bypass systems.

Another objective of the invention is to control over heating of a hot gas bypass system by utilizing condensed liquid brought off of the liquid line.

Other advantages of the invention should be readily apparent to those skilled in the art once the invention has been described.

DESCRIPTION OF THE PREFERRED EMBODIMENT

Figure 1:
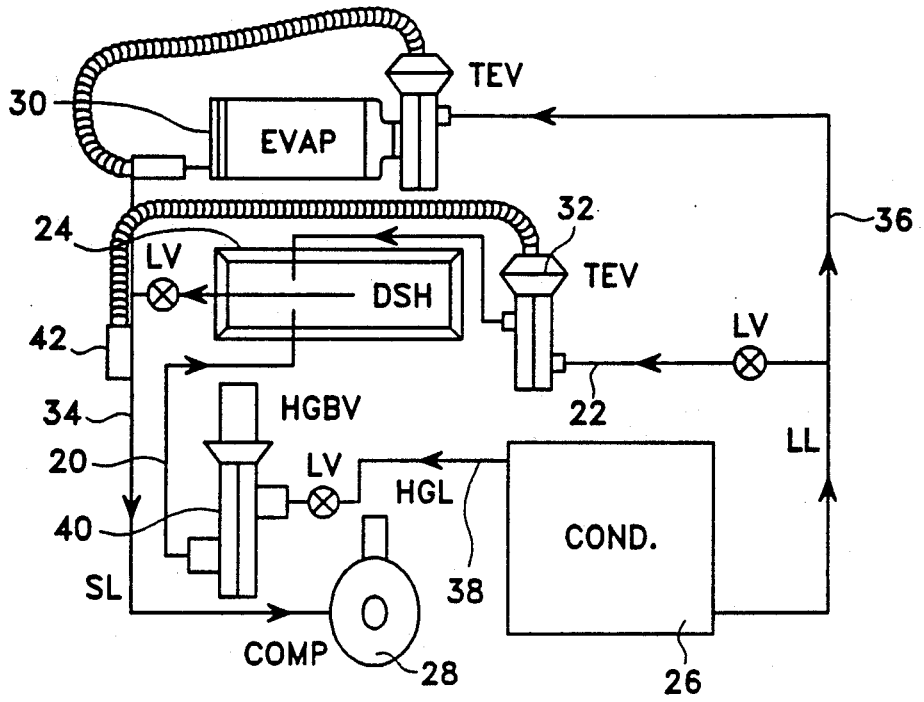
FIG. 1 shows overall system.
Figure 2:
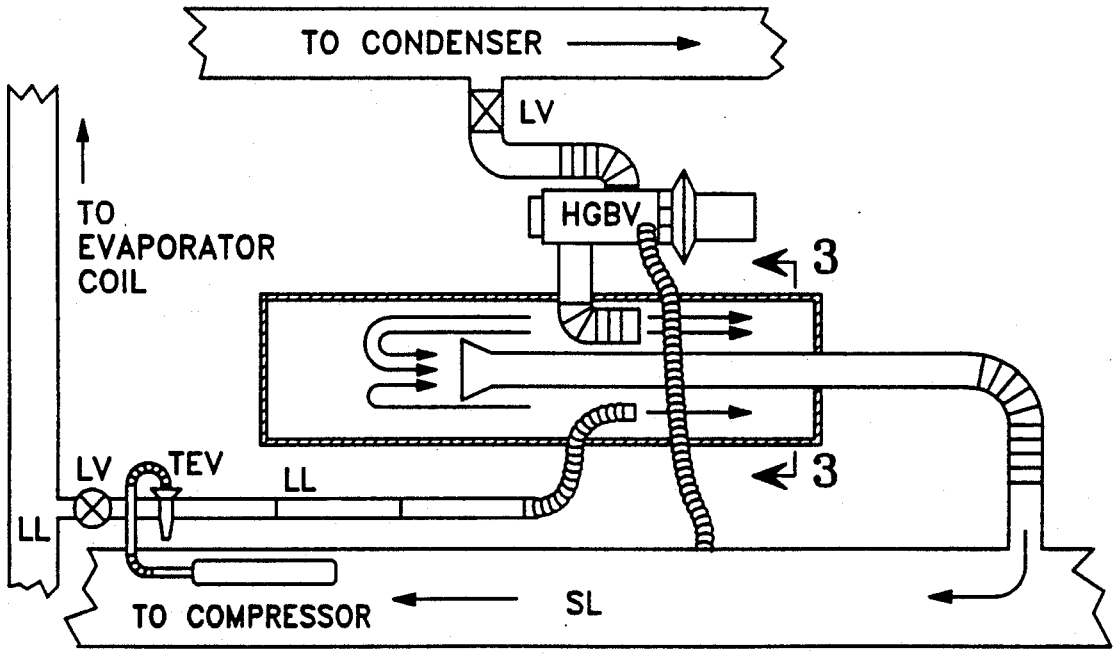
FIG. 2 shows detail of the desuper heat chamber
Figure 3:
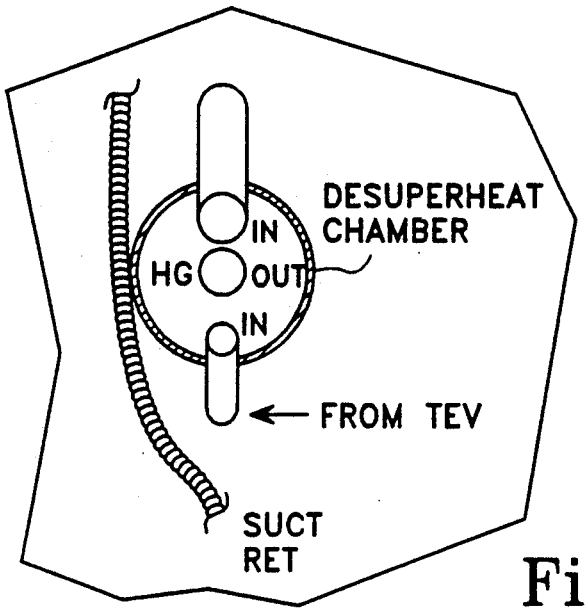
FIG. 3 shows side view of desuper heat chamber
Figure 4:
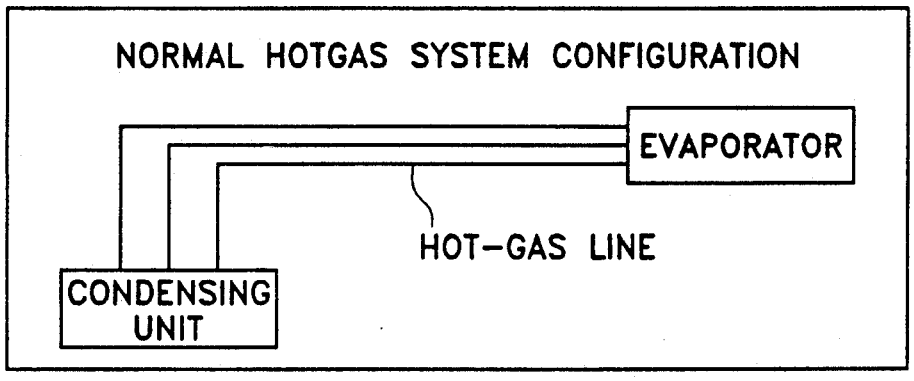
Fig. 4 (PRIOR ART)
FIG. 4 shows prior art configuration
Figure 5:
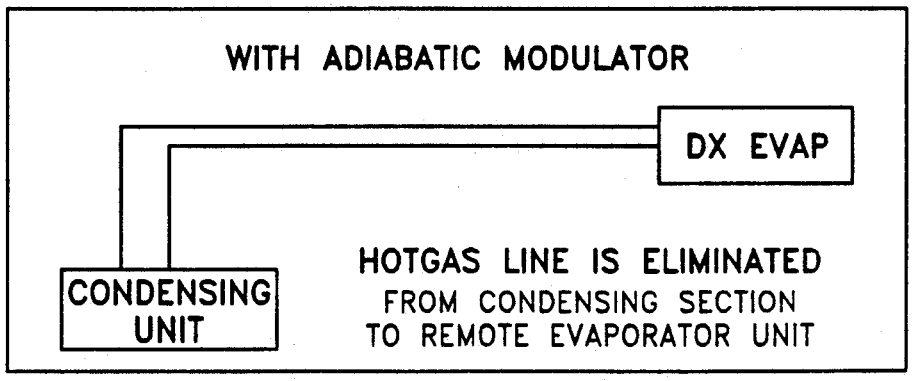
FIG. 5 shows configuration using the invention
Figure 6:
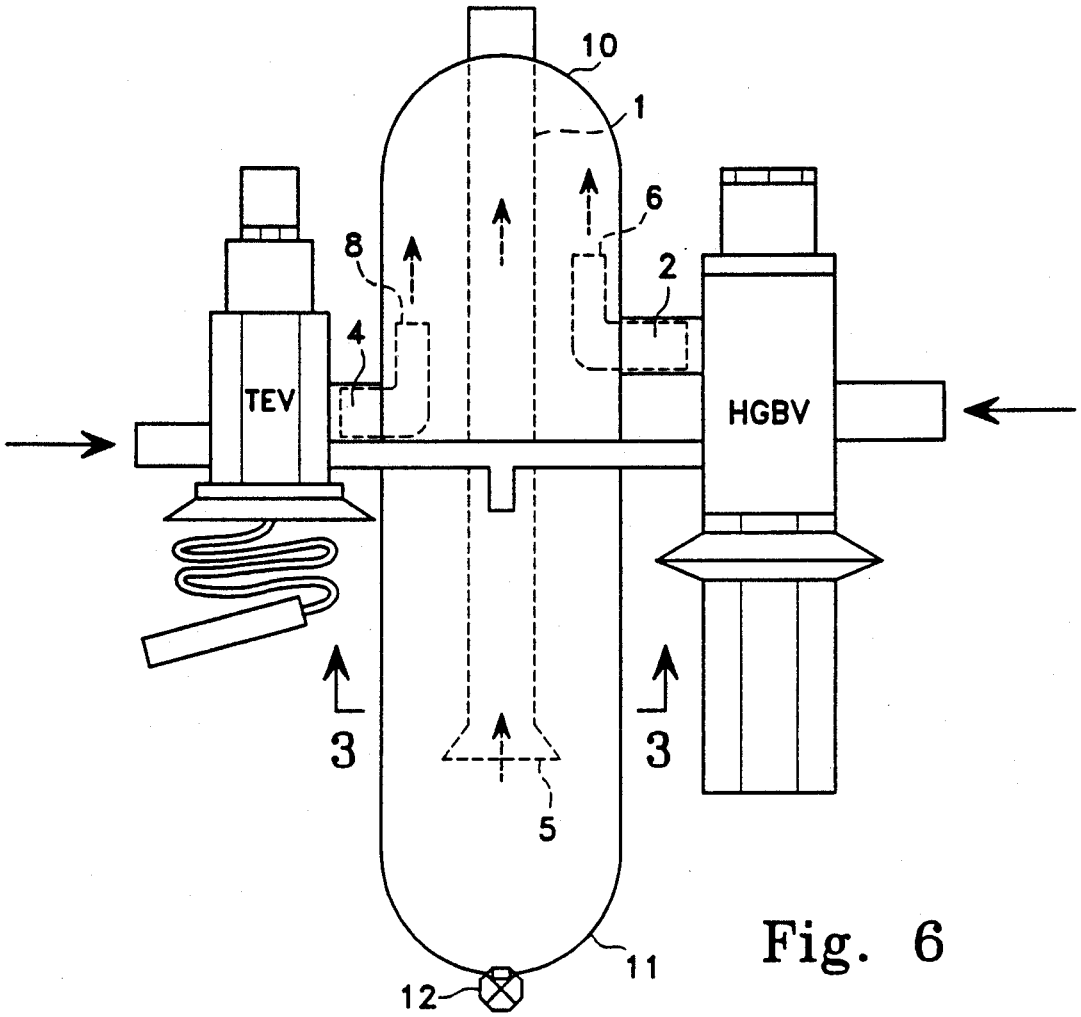
FIG. 6 shows cross section of the desuper heat chamber and entrance passages.

The overall set up of the system is shown in FIG. 1 Both a hot gas bypass line 20 and a liquid bypass line 22 are connected to the desuperheat chamber 24. From the desuper heat chamber, the gas is sent to the vacuum line 34 to respond to changes in pressure in the vacuum line.

The amount of hot gas bypassed back varies in proportion to the pressure in the suction line. As pressure decreases in the suction line, more gas needs to be cycled through the compressor 28 and so in response, the hot gas bypass valve 40 is opened, letting hot gas back into the desuper heat chamber and thence back to the vacuum line.

The liquid bypass valve is connected to the liquid line (leading from the condenser 26 to the evaporator 30) and diverts liquid from that line to the desuperheat chamber when pressure in the vacuum line reaches the limits set for the system. The liquid bypass is also controlled by the temperature in the suction line. A thermal expansion valve 32 with an external equalizer 42 (located on the vacuum line downstream of the point where the bypass gas is entering the vacuum line) may be used in this regard. As pressure in the vacuum line increases, the liquid expansion valve opens as much as necessary to allow the cool liquid from the liquid bypass line to mix with the hot gas in the desuperheat chamber and thereby cool the bypass gas being sent to the vacuum line. The liquid from the liquid line 36 will become a gas upon entering the desuper heat chamber.

The desuper heat chamber itself may preferably be of tubular construction and the entrance passage for the hot gas bypass line is a tubular inlet entering the chamber with passageway parallel to the main shape of the tube. The entrance for the liquid line is similar to the hot gas passage and also parallel to the main length of the tube. The liquid line entrance and the hot gas entrance should be on opposite sides of the desuper heat chamber to insure proper mixing before entering the vacuum line.

As the thermal expansion valve on the liquid line opens, the gases/liquid mix in the desuper heat chamber, a uniform temperature is achieved, and they are sent back to the vacuum line for further cycling in the compressor.

The invention close couples the entire hot gas bypass system within the condensing section of the refrigeration cycle, thereby reducing the piping required and increasing the efficiency of the system. It allows the hot gas bypass system to be installed in split systems with very little regard to the separation of the evaporator and condensing sections of the system. The design of the desuper heat chamber is such as to allow its set up in either a horizontal or vertical position based on system requirements. The control unit is designed to maintain continuous modulation of the refrigeration capacity of the system without incurring any damage to the hermetic compressor motor windings.

The system will allow the use of excessive or 100% make-up air input to what is normally a standard air conditioning system. Its limitations are governed by the basic capacity of the system design components. The modulation effect of the controller is continuous over the entire range of its selected components with compressor motor winding over-heat protected by the quench temperature setting of the Thermal Expansion Valve that varies the amount of liquid pulled off from the liquid line in accordance with the temperature of the suction line.

The preferred desuper heat chamber (DHC) is a closed cylinder with rounded ends, these are also referred to as spherically-shaped ends. One end, the exit end 10, is penetrated by a concentrically set mixed gas tube 1 which runs approximately three quarters of the length of the DHC with a flared entrance orifice 5. The mixed tube enters the chamber at the ext end 10 of the DHC chamber. The mixed tube runs three quarters of the way toward the closed end 11. Thus, the entrance end of the mixed tube lies inside the DHC chamber and provides for the entrance of hot gas and liquid from the thermal expansion valve (TEV) and the hot gas bypass valve (HGBV), these are the same valves and DHC shown in FIGS. 1–5.

The flared shape of the entrance orifice 5 reduces the dB level of the mixed gas glow. The closed end of the DHC is penetrated by a test port and charging valve 12 which allows one to measure the pressure and for charging and purging purposes.

Figure 7A:
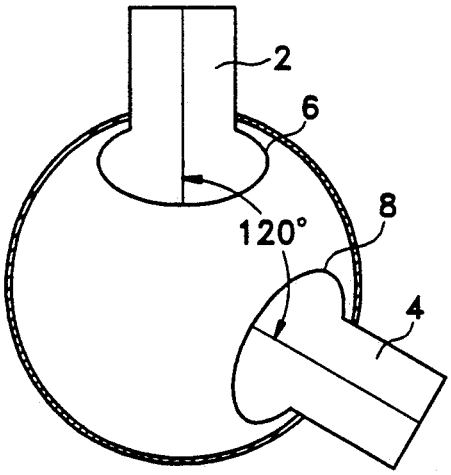
FIG. 7 shows cross section of desuper heat chamber and flared outward entrance passages.
Figure 7B:
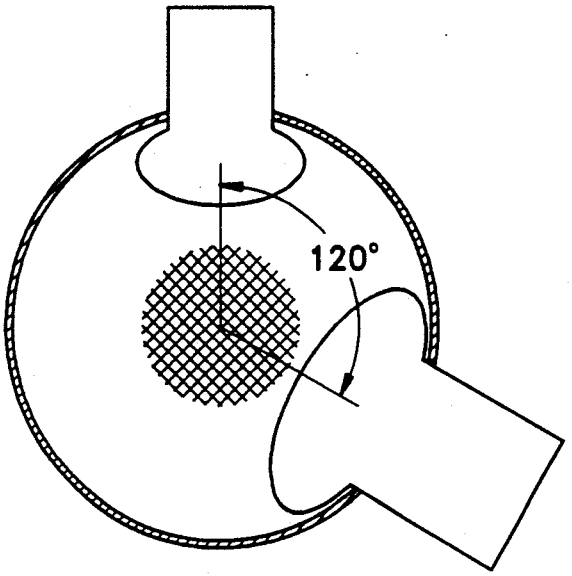

The DHC's side wall is of generally circular construction and is penetrated by hot gas and liquid vapor, entrance passages. The hot gas bypass valve passage 2 and thermal expansion valve passage 4 are set 120 degrees apart along an arc corresponding to the side wall of the DHC. See cross section FIG. 7. Passages 2 is in connection with the hot gas bypass line and passage 4 the liquid bypass line. Both passages enter the DHC through its circular shaped side wall and the two passages are about 120 degrees apart from one another as shown in FIG. 7. These two entrance passages are located at about three quarters of the way up the chamber as measured from the closed end 11.

Typical DHCs are about 8–10" long and are made of two shell halves, each of of 4" or 5" in length. Thus in an 8" DHC, there is likely to be about 2" of space between the entrance of the mixed gas tube and the bottom of the shell (closed end) and about 2" of space between the entrance passages of the TEV and the HGBV and the top of the DHC (the exit end).

The exit orifices 6,8 for each of these passages are flared outward as shown in FIG. 7 to form an elliptical shaped orifice inside the DHC. Both passages are of generally circular cross section for the most part except for the aforementioned flared outward exit orifice.

The flared outward orifices provide for a wide angle discharge pattern which is thought necessary to achieve the streamline turbulence and vary rapid gas mixing of the hot gas and liquid vapor across the upper end of the chamber area, without any appreciable pressure drop.

Measuring the gas pressure and temperature at a leaving chamber and test port allows the APR assembly to be set to control or achieve special conditions, when required. The adiabatic proportioning (APR) assembly when used in high temperature (40 degree suction, typically using #22 refrigerant) air conditioning equipment is set at 57 psi HGBV and 57 degrees F. for the thermal expansion valve for temperature and capacity control. However, the APR assembly may be used throughout the entire range of refrigeration equipment.

Without wishing to be bound by theory it is believed that the construction of the improved DSC achieves superior mixing of gas and vapor. It may be that the hot gas and vaporized liquid combine into a miscible gas through changing flow patterns in the DSC.

In addition, the design of the DSC permits the storage of oil (that has separated from refrigerant and accumulates in the DSC) until the system bypass flow increases to the point of reabsorption of the oil by the refrigerant. The close assembly of the DSC and both the hot gas bypass valve and the thermal expansion valve results in a rapid response to changes in system capacity and compressor protection.

I claim:

1. A hot gas bypass system for a gas refrigeration system comprising: condenser, compressor and evaporator sections having a low pressure line between said evaporator and said compressor sections, and a high pressure line between said compressor and and said condenser sections and a liquid line between said condenser and said expansion sections; said bypass section comprising: a hot gas bypass valve and a hot gas bypass line in connection with said high pressure line, a liquid bypass valve and a liquid bypass line in connection with said liquid line, said liquid bypass line and said hot gas bypass line in connection with a desuper heat chamber, said desuper heat chamber in connection with said low pressure line, said bypass valves having proportioning means for limiting the passing of said hot gas and said liquid in response to changes in pressure of said suction line, and said desuper heat chamber is of a generally cylindrical shape having closed, rounded ends, one of said ends designated the exiting end and the other of said ends designated the closed end, a mixed gas tube having an entrance opening and an exit opening said exit opening of said tube in connection with said exiting end, said tube of length about three quarters that of said desuper heat chamber, said desuper heat chamber having an HGV passage for the entrance of said hot gas bypass line and a TEV passage for the entrance of said liquid bypass line, each of said passages having exit ports located within said desuper heat chamber.

2. The apparatus of claim 1 where said HGV exit port and said TEV exit port are of flared outward construction.

3. The apparatus of claim 2 wherein said TEV and HGV exit ports are located about 120 degrees apart along the periphery of said cylindrical shape.

4. The apparatus of claim 3 wherein said entrance end of said mixed gas tube is of flared outward construction.

5. The apparatus of claim 4 where said HGV exit port and said TEV exit port are located about three fourth of the length of said desuper heat chamber measured from the closed end of said chamber.

6. A desuper heat chamber of a generally cylindrical shape having closed, rounded ends, one of said ends designated the exiting end and the other of said ends designated the closed end, a mixed gas tube having an entrance opening and an exit opening said exit opening of said tube in connection with said exiting end, said tube of length about three quarters that of said desuper heat chamber, said desuper heat chamber having an entrance passage for the entrance of a hot gas bypass line and an entrance passage for the entrance of a liquid bypass line, each of said passages having exit ports located within said desuper heat chamber.

7. The apparatus of claim 6 where said exit ports are of flared outward construction.

8. The apparatus of claim 7 wherein said exit ports are located about 120 degrees apart along the periphery of said cylindrical shape.

9. The apparatus of claim 8 wherein said entrance end of said mixed gas tube is of flared outward construction.

10. The apparatus of claim 9 where said exit ports are located about three fourths of the length of said desuper heat chamber measured from the closed end of said chamber.

* * * * *